United States Patent [19]

Morgan

[11] 3,971,194

[45] July 27, 1976

[54] SEPARABLE DOUBLE PLY SADDLE PAD

[76] Inventor: Veldon Morgan, Box 65, Ellsworth, Nebr. 69340

[22] Filed: Apr. 15, 1975

[21] Appl. No.: 568,191

[52] U.S. Cl. ..... 54/66
[51] Int. Cl.[2] ..... B68C 1/12
[58] Field of Search ..... 54/65, 66, 67, 68, 41, 54/44, 79; 5/334 R

[56] References Cited

UNITED STATES PATENTS

| | | | |
|---|---|---|---|
| 2,832,967 | 5/1958 | Sobel | 5/334 R |
| 3,323,287 | 6/1967 | Hilmer | 54/66 |
| 3,355,748 | 12/1967 | Tuvert | 5/334 R |
| 3,774,249 | 11/1973 | Ybarra et al. | 5/334 R |
| 3,807,136 | 4/1974 | Deal | 54/66 |

*Primary Examiner*—Jack Q. Lever
*Attorney, Agent, or Firm*—Clarence A. O'Brien; Harvey B. Jacobson

[57] ABSTRACT

A multi-ply pad is provided for disposition between the back of a domestic animal such as a horse and a saddle placed upon the horse's back. The pad includes a first lower ply having a flexible backing layer with a dense fibrous pile layer carried by the undersurface of the backing layer. The pile layer may be termed a fiber-on-end pile layer. The first and second layers include corresponding spaced peripheral portions and coacting fastener structure is provided on the corresponding spaced peripheral portions releasably securing the latter together with the upper and lower plies being free of direct connection with each other, independent of the fastening structure, for at least limited relative shifting of the plies of the pad in the areas thereof spaced from the fastening structure. In addition, the coating fastener structure carried by the corresponding spaced peripheral portions of the upper and lower plies of the pad include structure operative to allow releasable securement of the corresponding spaced peripheral portions together in at least slightly relatively shifted registered positions.

7 Claims, 3 Drawing Figures

SEPARABLE DOUBLE PLY SADDLE PAD

BACKGROUND OF THE INVENTION

Various forms of saddle pads and harness pads as well as padding utilized for the comfort of bedridden patients to prevent bedsores and other skin irritations have been heretofore provided. Examples of some of these previous types of pads and padding structures are disclosed in U.S. Pat. Nos. 557,885, 565,757, 1,129,847, 3,417,413, 3,466,852 and 3,807,136.

In the patent to Stanley E. Deal, U.S. Pat. No. 3,807,136, a double ply saddle pad is provided by arranging two plies each consisting of a flexible backing layer and a dense fibrous pile layer in back-to-back relation. This saddle pad or blanket includes peripheral edge portions which are secured together in addition to specifically designed zones of intermediate portions of the plies which are secured together in a manner to tightly compress the fibrous pile layers of the plies of the pad in the central portions thereof which are secured together for the purpose of providing air circulation pathways to facilitate moisture evaporation and resultant cooling of the animal's hide upon which the saddle pad is disposed. However, presently available dense fibrous pile plies presently available tend to work particles of dirt and other foreign material through the dense pile layer thereof and into and through the backing layer. Accordingly, although individual plies of this type may be readily machine washed, when two such plies are secured together in the manner above set forth dirt and other particles become trapped between the backing layers to the extent that they are not readily washed from the saddle pad. Furthermore, when two plies disposed in superposed relation are draped over the compound curvature of the back of a horse there is a tendency for one of the plies to shift relative to the other and for various marginal portions of the plies to shift relative to each other in order that each ply may more readily conform to the compound curvature of the back of the animal over which the pad is draped. However, when the two plies of a pad of this type are secured together about corresponding marginal portions in a non-removable manner and corresponding central portions of the plies are also secured together against relative shifting, slight relative shifting between corresponding portions of the plies of such a saddle pad is substantially eliminated with the result that the underply may become wrinkled or bunched thereby establishing an area of high pressure when the weight of a saddle and its occupant bears down upon such a wrinkled lower ply portion.

SUMMARY OF THE INVENTION

The present invention is constructed in a manner whereby the two plies of a double ply saddle pad may be readily separated for ease in washing both of the plies and substantial complete removal of dirt and other particles from the plies as a result of being washed. Further, the relatively separable plies of the saddle pad of the instant invention enable different washing and/or cleaning processes to be utilized on each ply in the event the materials of which the plies are constructed are different and respond more favorably to different cleaning methods. Still further, by providing a multi-ply saddle pad in a manner such that the plies thereof may have different corresponding portions at least slightly shifted in registration relative to each other, more complete conformity of the saddle pad comprising the multiple plies to the compound curvature of the back of a horse is assured.

The main object of this invention is to provide a multi-ply saddle pad constructed in a manner which will substantially eliminate saddle sores on a horse.

Another object of this invention is to provide a saddle pad of multi-ply construction and with the multiplies thereof relesably secured together in a manner such that the individual plies may be separately washed or cleaned.

Another very important object of this invention is to provide a multi-ply saddle pad with means provided for securing spaced peripheral portions of the plies together in at least slightly shifted relative positions.

A further object of this invention is to provide a multi-ply saddle pad with only spaced peripheral portions of the plies of the pad secured together and all of the remaining portions of the saddle pad plies free of direct positive engagement with each other in order to enable slight shifting in the registry of those corresponding portions of the saddle pad plies which are not secured together.

Another very important object of this invention is to provide a double ply saddle pad including a lower ply specifically constructed to provide comfort to the horse and an upper ply constructed so as to enable secure seating of an associated saddle on the saddle pad.

A final object of this invention to be specifically enumerated herein is to provide a multi-ply saddle pad in accordance with the preceding objects and which will conform to conventional forms of manufacture, be of simple construction and easy to use and clean so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a multi-ply saddle pad constructed in accordance with the present invention.

Figure 1:
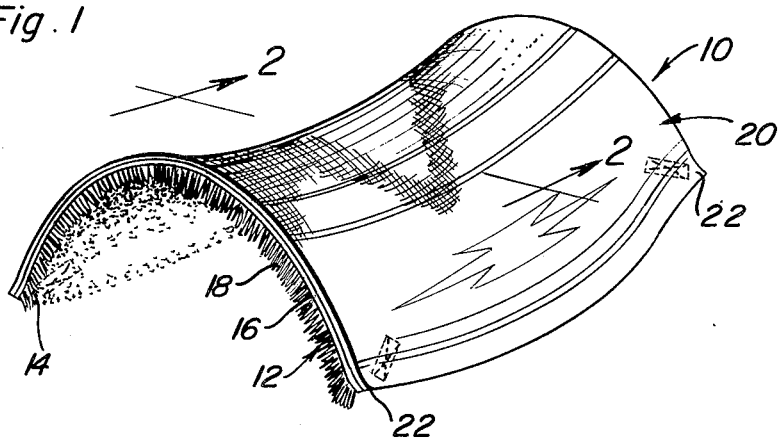
FIG. 1 is a perspective view of the multi-ply saddle pad of the instant invention in a compound curved configuration such as that which the saddle pad assumes when disposed on the back of a horse.
Figure 2:
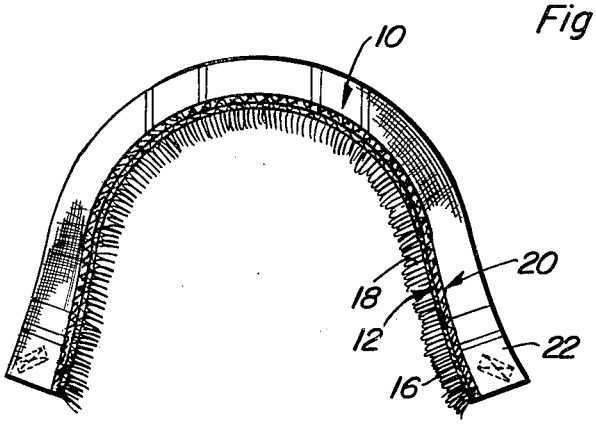
FIG. 2 is an enlarged transverse vertical sectional view taken substantially upon the plane indicated by the section line 2—2 of FIG. 1.
Figure 3:
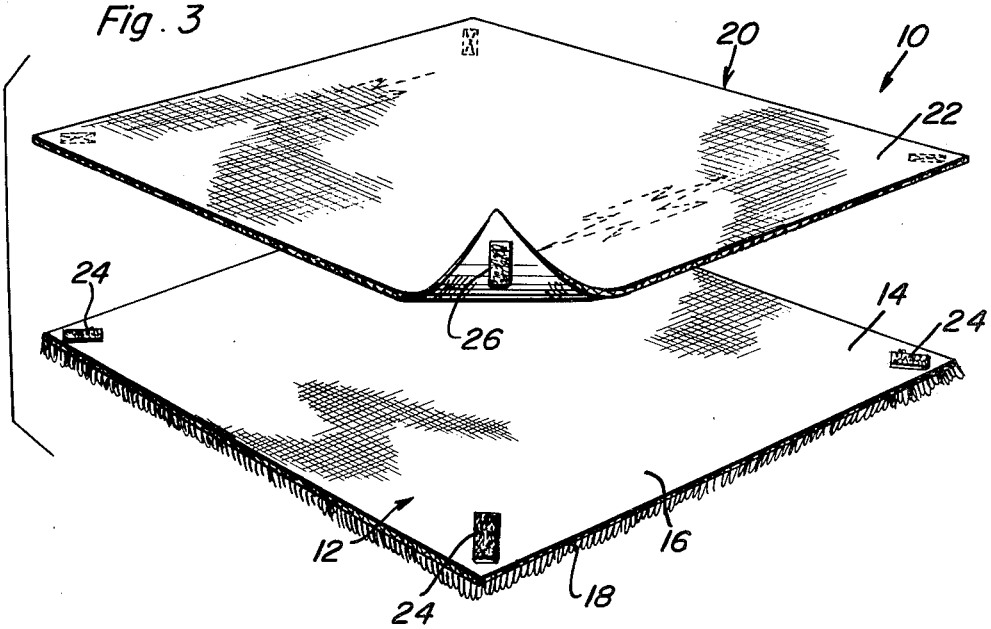
FIG. 3 is an exploded perspective view of the multi-ply saddle pad illustrating the releasable fastener structure by which the corresponding corner portions of the two plies of the pad may be removably secured together.

From FIG. 3 of the drawings it may be seen that the saddle pad 10 includes a first lower ply referred to in general by the reference numeral 12 and that the lower ply 12 is generally rectangular in configuration including four corner portions 14. The ply 12 includes a flexible backing layer 16 and a fibrous pile layer 18 carried by the undersurface of the backing layer 16. The pile layer 18 may be said to comprise a fiber-on-end pile layer. For example, the first lower ply 12 may comprise a panel of "Kodel" or other similar panel.

The pad 10 further includes a second upper ply referred to in general by the reference numeral 20. The ply 20 may be constructed of any suitable material such as a woven panel. Preferably, a relatively thick panel such as a Navajo-type blanket of woven material is used for the second upper ply. However, other relatively thick plies of different materials, either woven or matted may be used for the second upper ply 20.

The upper ply 20 is also rectangular in plan shape and includes four corner portions 22. The corner portions 14 include a first set of a first form of "Velcro" strips 24 secured to the upper surfaces thereof and the corner portions 22 of the second upper ply 20 include a second set of a second form of "Velcro" strips 26 secured to the undersurfaces thereof. Of course, corresponding strips 24 and 26 are releasably engageable with each other to secure the plies 12 and 20 together in superposed relation. The corresponding corner portions 14 and 22 define spaced marginal portions of the plies 12 and 20 and it will be noted that major corresponding portions of the plies 12 and 20 are free of direct connection with each other. Accordingly, major portions of the peripheries of the plies 12 and 20 may shift slightly in registry relative to each other. Furthermore, the entire central portions of the plies 12 and 20 spaced inwardly of the marginal portions thereof are free of direct securement to each other. Accordingly, the central portions of the plies 12 and 20 may shift slightly in registry relative to each other.

In addition to the strips 24 and 26, other forms of releasably engageable fastening means may be used. However, the strips 24 and 26 are releasably engageable with each other in slightly relatively shifted registered positions and accordingly, the two plies 12 and 20 may be successively placed upon the back of an associated horse with the lower ply 12 first placed in position in order to enable the ply 12 to assume its own compound curvature in conforming to the back of the horse and the second upper ply 20 may thereafter be laid over the lower ply 12 in order that the second upper ply 20 may also assume its own compound curvature when conforming to the shape of the back of the horse. After the upper ply 20 has been applied over the lower ply 12, the corresponding corner portions of the plies 12 and 20 may then be secured together by means of the strips 24 and 26.

Inasmuch as the plies 12 and 20 may be readily separated for cleaning purposes, each ply may be cleaned in the most advantageous manner according to the type of material utilized in the construction of that ply. Further, any dirt working between the plies 12 and 20 during use of the pad 10 may be readily washed free of the individual plies 12 and 20 inasmuch as the plies 12 and 20 are to be separated for cleaning or washing purposes. Still further, inasmuch as the ply 12 may become more quickly soiled, it is possible that the ply 20 may be used two or three times with only the ply 12 being substituted for by a clean identical ply or being washed between each usage of the pad 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multi-ply saddle pad including a first flexible lower ply having a flexible backing layer with a dense fibrous pile layer carried by the undersurface of said backing layer, said flexible lower ply being capable of being draped over the compound curvature saddle supporting back surfaces of a domestic animal to be saddled with said lower ply conforming to the compound curvature of said back surfaces, a flexible second ply overlying said first ply in at least substantial registry therewith and capable of conforming to the compound curvature of the first lower ply resulting from its being draped over said back surfaces, said first and second plies including corresponding peripheral portions spaced thereabout, coacting fastener means releasably stationarily securing corresponding peripheral portions of said plies together against shifting relative to each other, said plies being free of direct connection with each other independent of said fastening means, and said fastening means including means operative to allow stationary releasable securement of said corresponding peripheral portions together in at least slightly randomly relatively shifted positions.

2. The combination of claim 1 wherein said second upper ply comprises a ply which, when said plies are compressed by the weight of a saddle and its occupant thereon, is of a greater thickness then said first lower ply.

3. The combination of claim 2 wherein said second upper ply comprises a layer of relatively coarse woven material.

4. The combination of claim 3 wherein said material of which said second upper ply comprises wool.

5. The combination of claim 1 wherein said fastener means comprises coacting strips of "Velcro" type material secured to opposing surfaces of said corresponding spaced peripheral portions.

6. The combination of claim 1 wherein said plies are generally rectangular in plan shape and said corresponding spaced peripheral portions comprise corresponding corner portions of said plies.

7. The combination of claim 6 wherein said fastener means comprises coacting strips of "Velcro" type material secured to opposing surfaces of said corresponding spaced peripheral portions.

* * * * *